US008179244B2

(12) United States Patent
You

(10) Patent No.: US 8,179,244 B2
(45) Date of Patent: May 15, 2012

(54) REMOTE CONTROL SYSTEM AND METHOD HAVING REDUCED VULNERABILITY TO NOISE

(75) Inventor: Byeong-Gyun You, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1722 days.

(21) Appl. No.: 11/476,035

(22) Filed: Jun. 28, 2006

(65) Prior Publication Data

US 2007/0069918 A1 Mar. 29, 2007

(30) Foreign Application Priority Data

Sep. 23, 2005 (KR) ..... 10-2005-0088952

(51) Int. Cl.
*G08C 19/00* (2006.01)

(52) U.S. Cl. ..... 340/453; 341/176

(58) Field of Classification Search ..... 340/825.69, 340/825.57, 12.15, 12.16, 12.22; 341/176; 348/734; 398/106
See application file for complete search history.

(56) References Cited

U.S. PATENT DOCUMENTS 5,182,551 A * 1/1993 Goto ..... 340/825.24
5,469,152 A * 11/1995 Yamamoto et al. ..... 340/825.63
6,049,293 A * 4/2000 Koot et al. ..... 340/825.69

FOREIGN PATENT DOCUMENTS

JP 03-270596 12/1991

OTHER PUBLICATIONS

Korean Office Action for Korean Patent Application No. 2005-0088952 issued on Oct. 30, 2006.

* cited by examiner

*Primary Examiner* — Brian Zimmerman
*Assistant Examiner* — Yong Hang Jiang
(74) *Attorney, Agent, or Firm* — H.C. Park & Associates, PLC

(57) ABSTRACT

A remote control system and method having reduced vulnerability to noise. In an environment having noise at a frequency of infrared signals transmitted by a remote controller, errors and malfunctions in a remote control receiving device such as a set top box are controlled by selectively transmitting an entire code including header pulses and data pulses, or a repeat code including header pulses, data pulses and repeater pulses from the remote controller, and receiving and using the entire code or repeat code at the remote receiving device.

20 Claims, 8 Drawing Sheets

REMOTE CONTROL SYSTEM AND METHOD HAVING REDUCED VULNERABILITY TO NOISE

CLAIM OF PRIORITY

This application makes reference to, incorporates the same herein, and claims all benefits accruing under 35 U.S.C. §§119 from an application for APPARATUS AND METHOD FOR NOISE REDUCTION OF REMOTE CONTROL SYSTEM filed in the Korean Intellectual Property Office on Sep. 23, 2005 and there duly assigned Ser. No. 10-2005-0088952.

BACKGROUND OF THE INVENTION

1. Field of the Invention

The present invention relates to a remote control system and method having reduced vulnerability to noise.

2. Description of the Related Art

Generally, a remote controller is a device for remotely controlling via wireless transmission various functions of electronic equipment such as a TV, a VCR, an audio system, an air conditioner, a cable broadcast converter, a digital broadcast set top box, a satellite broadcast converter, an electric fan, etc.

A remote control system generally includes a remote control transmitting part and receiving part. The receiving part, such as a set top box, can comprise an infrared port, a signal decoding module, a signal analysis module, and a main processor.

The infrared port is a device for receiving a remote control signal in the infrared band from the remote control transmitting part. The infrared port receives both an infrared signal from the remote control transmitting part and a signal having noise. The infrared port transmits a received signal to the signal decoding module. Here, the signal transmitted to the signal decoding module has the form of a pulse.

The signal decoding module decodes a pulse signal received at the infrared port. For example, in the case of receiving an arbitrary pulse signal, the signal decoding module analyzes the pulse signal and decodes it according to a Pulse Code Modulation (PCM) demodulation scheme. Numeric data decoded according to the scheme is transmitted to the signal analysis module.

The signal analysis module combines the numeric data received from the signal decoding module and matches them with instructions stored in advance. The matched instructions are transmitted to the main processor which then executes the instructions and displays a result on a display unit such as a TV set.

The remote controller and set top box described above have the following problems.

Generally, in the process of transmitting an infrared signal of the remote controller to control an operation of the set top box, there is interference due to noise. When the noise is stronger than the remote control signal, information cannot be transmitted normally. Take for example the case of using the remote controller in the vicinity of a Tri-phosphor lamp. An infrared frequency emitted by the remote controller is 38 KHz or 56 KHz, and the Tri-phosphor emits within the frequency band of 30 to 50 KHz. Thus, interference occurs between the remote controller's 38 KHz signal and Tri-phosphor radiation. The closer the Tri-phosphor lamp is positioned to the set top box, the stronger the noise from the Tri-phosphor becomes. If the noise becomes stronger than the remote control signal, the remote controller will likely not operate normally. Of course, Tri-phosphor emission is only one example out of many possible sources of noise interfering with normal operation of the remote controller.

In particular, when the user repeatedly pushes the same button of the remote controller after an error caused by noise, since repeated pushes of the same button cause only repeater pulses to be output, the same error that occurred with the first push of the button is repeated. Accordingly, the set top box, when positioned near a light source such as a Tri-phosphor lamp, has a poor reception of the infrared remote controller signal.

SUMMARY OF THE INVENTION

It is an objective of the present invention to provide a remote control system including a remote controller for repeatedly transmitting an entire code including header pulses and data pulses, or transmitting a repeat code including header pulses, repeater pulses and data pulses, and a remote control signal reception unit for receiving the entire code or repeat code and suppressing remote controller malfunction using the entire code or repeat code, and a method thereof.

According to an aspect of the present invention, there is provided a remote control system comprising: a remote controller for transmitting at least one of a remote control signal including header pulses and data pulses, and a remote control signal including header pulses, data pulses, and repeater pulses having a first pulse length or a second pulse length depending on whether the transmission is an original transmission or a retransmission; and a remote control receiver for receiving and decoding the remote control signal, and selectively processing instructions corresponding to the remote control signal.

The remote control receiver may include: a signal decoding module for extracting numeric data by decoding the received remote control signal and checking a time when the remote control signal is decoded and a length of the repeater pulses; a signal analysis module for determining whether or not to process instructions corresponding to the numeric data using the decoding time and the length of the repeater pulses; and a main processor for processing the instructions corresponding to the numeric data. Also, the signal analysis module may include a signal mapping module for transmitting instructions mapped to the numeric data to the main processor; an entire signal processing module for activating the signal mapping module when the repeater pulses have a first pulse length and the difference between the time when the remote control signal is decoded and the time when an immediately preceding remote control signal is decoded is longer than a period of the remote control signal; and a repeat code processing module for activating the signal mapping module when the repeater pulses have a second pulse length and the numeric data generated by decoding the remote control signal is different from numeric data generated by decoding an immediately preceding remote control signal. The length of the first pulse may be 4.5 ms and the length of the second pulse may be 2.25 ms.

According to another aspect of the present invention, there is provided a remote control receiver comprising an infrared port for receiving at least one of a remote control signal including header pulses and data pulses, and a remote control signal including header pulses, data pulses, and repeater pulses having a first pulse length or a second pulse length depending on whether the transmission is an original transmission or a retransmission; a signal decoding module for extracting numeric data by decoding the received remote control signal and checking a time when the remote control signal is decoded and a length of the repeater pulses; a signal analysis module for determining whether or not to process instructions corresponding to the numeric data using the decoding time and the length of the repeater pulses; and a main processor for processing the instructions corresponding to the numeric data.

According to still another aspect of the present invention, there is provided a remote controller comprising a signal encoding module for transmitting at least one of a remote control signal including header pulses and data pulses, and a remote control signal including header pulses, data pulses, and repeater pulses having a first pulse length or a second pulse length depending on whether the transmission is an original transmission or a retransmission.

According to yet another aspect of the present invention, there is provided a remote control system comprising a remote controller for repeatedly transmitting an entire code including header pulses and data pulses in a predetermined time; and a remote control receiver for receiving and decoding the entire code, and selectively processing instructions corresponding to the entire code using the decoding time.

The remote control receiver may include: a signal decoding module for extracting numeric data by decoding the received entire code, and checking the decoding time; a signal analysis module for determining whether or not to process instructions corresponding to the numeric data using the decoding time; and a main processor for processing the instructions corresponding to the numeric data. Further, the signal analysis module may include: a signal mapping module for transmitting instructions mapped to the numeric data to the main processor; and an entire signal processing module for activating the signal mapping module when the difference between a time when the entire code is decoded and a time when an immediately preceding entire code is decoded is longer than an entire code period.

According to yet another aspect of the present invention, there is provided a remote control receiver comprising: an infrared module for receiving an entire code including header pulses and data pulses; a signal decoding module for extracting numeric data by decoding the received entire code, and checking the decoding time; a signal analysis module for determining whether or not to process instructions corresponding to the numeric data using the decoding time; and a main processor for processing the instructions corresponding to the numeric data.

According to yet another aspect of the present invention, there is provided a remote controller comprising a signal encoding module for repeatedly transmitting an entire code including header pulses and data pulses in a predetermined time in preparation for an error.

According to yet another aspect of the present invention, there is provided a remote control system comprising: a remote controller for repeatedly transmitting a repeat code including header pulses, data pulses, and repeater pulses having a first pulse length or a second pulse length depending on whether the transmission is an original transmission or a retransmission; and a remote control receiver for receiving and decoding the repeat code, and selectively processing instructions corresponding to the repeat code using the repeater pulses.

The remote control receiver may include: a signal decoding module for extracting numeric data by decoding the received repeat data, and checking the length of the repeater pulses; a signal analysis module for determining whether or not to process instructions corresponding to the numeric data using the length of the repeater pulses; and a main processor for processing the instructions corresponding to the numeric data. Further, the signal analysis module may include: a signal mapping module for transmitting instructions mapped to the numeric data to the main processor; and a repeat code processing module for activating the signal mapping module when the repeater pulses have a first pulse length, and when the repeater pulses have a second pulse length and the numeric data generated by decoding the repeat code is different from numeric data generated by decoding an immediately preceding repeat code. Also, the first pulse length may be 4.5 ms and the second pulse length may be 2.25 ms.

According to yet another aspect of the present invention, there is provided a remote control receiver comprising: an infrared port for receiving a repeat code including header pulses, data pulses, and repeater pulses having a first pulse length or a second pulse length according to whether a transmission is an original transmission or a retransmission; a signal decoding module for extracting numeric data by decoding the repeat code and checking the length of the repeater pulses; a signal analysis module for determining whether or not to process instructions corresponding to the numeric data using the length of the repeater pulses; and a main processor for processing the instructions corresponding to the numeric data.

According to yet another aspect of the present invention, there is provided a remote controller comprising a signal encoding module for repeatedly transmitting a repeat code including header pulses, data pulses, and repeater pulses having different pulse lengths depending on whether the transmission is an original transmission or a retransmission in preparation for an error.

The signal encoding module may transmit repeater pulses having a pulse length of 4.5 ms in an original transmission, and repeater pulses having a pulse length of 2.25 ms in a retransmission.

According to yet another aspect of the present invention, there is provided a remote control method comprising the steps of: transmitting at least one of a remote control signal including header pulses and data pulses, and a remote control signal including header pulses, data pulses, and repeater pulses having a first pulse length or a second pulse length depending on whether the transmission is an original transmission or a retransmission; and receiving and decoding the remote control signal, and selectively processing instructions corresponding to the remote control signal using a time when the remote control signal is decoded and the repeater pulses.

The step of selectively processing the instructions corresponding to the remote control signal may include the steps of: extracting numeric data by decoding the received remote control signal and checking the decoding time and the length of the repeater pulses; processing the instructions corresponding to the numeric data when the repeater pulses have a first pulse length and the difference between the time when the remote control signal is decoded and the time when an immediately preceding remote control signal is decoded is longer than a period of the remote control signal; and processing the instructions corresponding to the numeric data when the repeater pulses have a second pulse length and the numeric data generated by decoding the remote control signal is different from numeric data generated by decoding an immediately preceding remote control signal.

According to yet another aspect of the present invention, there is provided a remote control method comprising the steps of: repeatedly transmitting, at a remote controller, an entire code including a header pulse signal and a data pulse signal in a predetermined time; and receiving and decoding the entire code, and processing instructions corresponding to the entire code selectively using the decoding time.

The step of processing the instructions corresponding to the entire code may include the steps of: extracting numeric data by decoding the received entire code, and checking the decoding time; and processing the instructions corresponding to the numeric data when the difference between the time when the entire code is decoded and a time when an immediately preceding entire code is decoded is longer than a period of the entire code signal.

According to yet another aspect of the present invention, there is provided a remote controlling method comprising the steps of: repeatedly transmitting, at a remote controller, a repeat code including header pulses, data pulses, and repeater pulses having a first pulse length or a second pulse length according to whether a transmission is an original transmission or a retransmission; and receiving and decoding the repeat code, and selectively processing instructions corresponding to the repeat code using the length of the repeater pulse.

The step of selectively processing the instructions corresponding to the repeat code may include the steps of: extracting numeric data by decoding the received repeat code, and checking the length of the repeater pulses; and processing the instructions corresponding to the numeric data when the repeater pulses have a first pulse length, and when the repeater pulses have a second pulse length and the numeric data generated by decoding the repeat code is different from numeric data generated by decoding an immediately preceding repeat code.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF EXEMPLARY EMBODIMENTS

Figure 1:
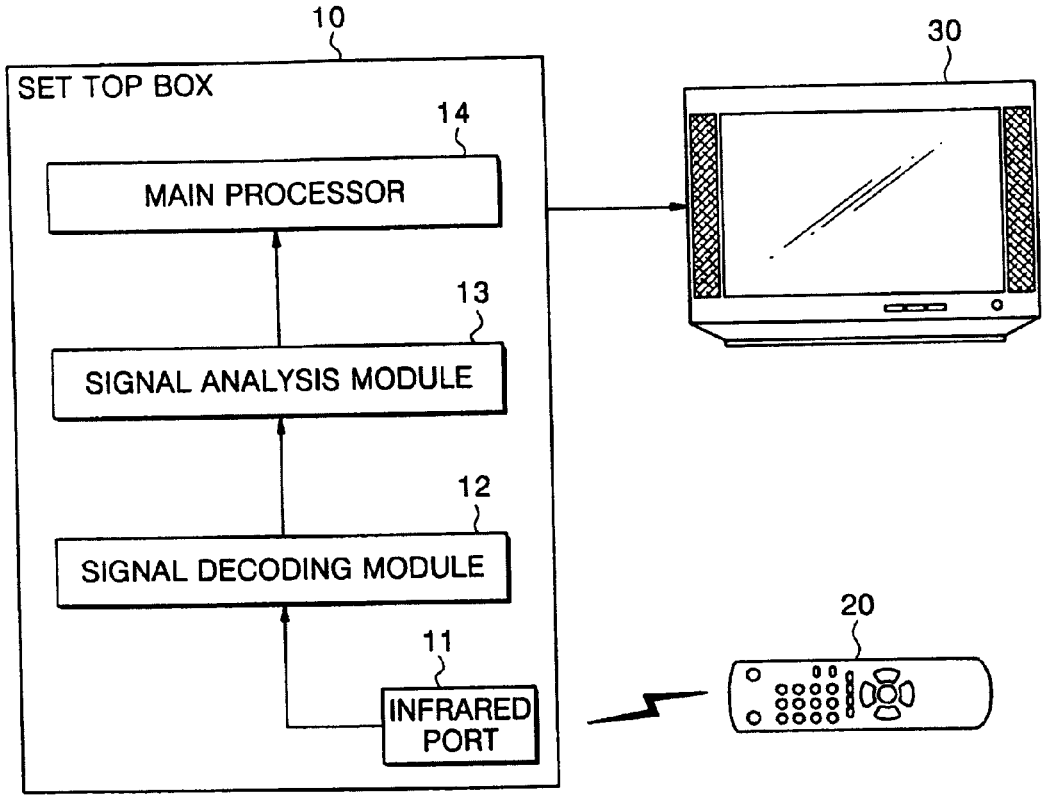
FIG. 1 is a block diagram of the internal configuration of a remote control system.

The present invention will now be described more fully with reference to the accompanying drawings, in which exemplary embodiments of the invention are shown. This invention may, however, be embodied in different forms and should not be construed as limited to the exemplary embodiments set forth herein. Rather, these exemplary embodiments are provided so that this disclosure will be thorough and complete, and will fully convey the scope of the invention to those skilled in the art. Like reference numerals refer to like elements throughout the specification and drawings.

FIG. 1 is a block diagram of the internal configuration of a remote control system.

As shown in FIG. 1, a set top box 10 can comprise an infrared port 11, a signal decoding is module 12, a signal analysis module 13, and a main processor 14.

The infrared port 11 is a device for receiving a remote control signal in the infrared band from a remote controller 20. The infrared port 11 receives both an infrared signal from the remote controller 20 and a signal having noise. The infrared port 11 transmits a received signal to the signal decoding module 12. Here, the signal transmitted to the signal decoding module 12 has the form of a pulse. A configuration of the pulse signal will be described in detail with reference to FIG. 2.

The signal decoding module 12 decodes a pulse signal received at the infrared port 11. For example, in the case of receiving an arbitrary pulse signal, the signal decoding module 12 analyzes the pulse signal and decodes it according to a Pulse Code Modulation (PCM) demodulation scheme. Numeric data decoded according to the scheme is transmitted to the signal analysis module 13.

The signal analysis module 13 combines the numeric data received from the signal decoding module 12 and matches them with previously stored instructions. The matched instructions are transmitted to the main processor 14 which then executes the instructions, which may be displayed as a result on a display unit 30 such as a TV set.

Figure 2:
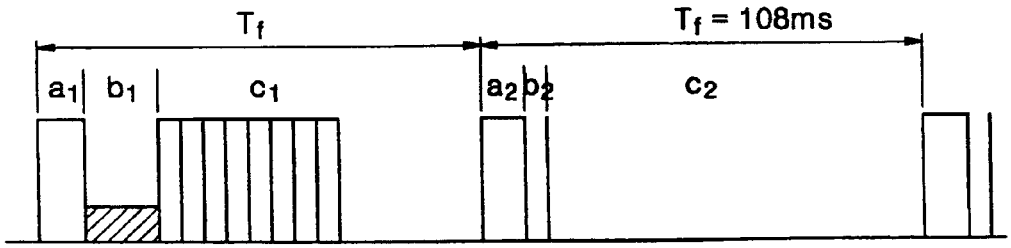
FIG. 2 shows a remote control signal used in the remote control system of FIG. 1.

FIG. 2 shows a remote control signal used in a remote control system.

The remote control signal transmitted by the remote controller 20 comprises header pulses a1 and a2, repeater pulses b1 and b2, and data pulses c1 and c2. The header pulses a1 and a2 mean that the remote control signal is transmitted to the set top box 10 by the remote controller 20. The set top box 10 recognizes the header pulses a1 and a2 and then decodes the data pulses c1 and c2 following the header pulses. The data pulses c1 and c2 are signals that are encoded from data, such as numeric data, transmitted to the set top box from the remote controller 20. The repeater pulses b1 and b2 indicate that given data is a signal corresponding to the same data as the remote control signal transmitted immediately before.

When a user pushes a button of the remote controller 20, the remote controller 20 transmits the pulse signal shown in FIG. 2. First, the remote controller 20 transmits the header pulses so that the data pulse signals corresponding to remote controller buttons are transmitted in a predetermined interval. The set top box 10 decodes the data pulse signals transmitted in such a scheme and processes instructions corresponding to the data pulse signals. When the user repeatedly pushes the same button of the remote controller 20, header pulses and data pulses are transmitted the first time only and header pulses and repeater pulses are transmitted thereafter.

Figure 3:
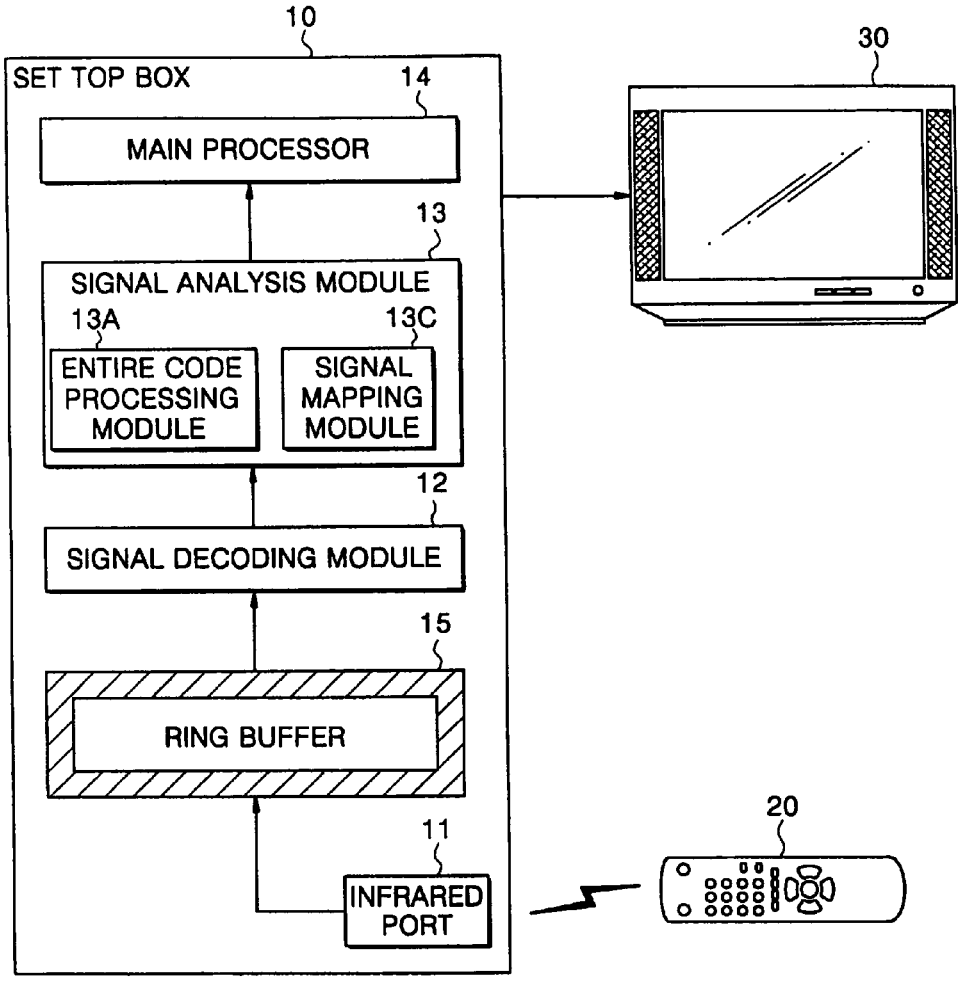
FIG. 3 is a block diagram showing the internal configuration of a remote control system according to an exemplary embodiment of the present invention.

FIG. 3 is a block diagram showing the internal configuration of a remote control system according to an exemplary embodiment of the present invention.

Referring to FIG. 3, a set top box 10 can be configured of an infrared port 11, a signal decoding module 12, a signal analysis module 13, a main processor 14, and a ring buffer 15.

The main processor 14 and the infrared port 11 perform the same operation as in the set top box described with reference to FIG. 1.

The ring buffer 15 temporarily stores a pulse signal transmitted from the infrared port 11. When all 32 bits of a pulse signal are received, the ring buffer 15 transmits the pulse signal to the 12 signal decoding module 12. The signal decoding module 12 decodes the received pulse signal and then transmits numeric data corresponding to the decoded signal together with a decoding time to the signal analysis module 13. The signal analysis module 13 analyzes and maps the received numeric data and transmits instructions corresponding to the numeric data to the main processor 14.

The signal analysis module 13 can include an entire code processing module 13A and a signal mapping module 13C. The entire code processing module 13A determines whether the received pulse signal is a retransmitted signal or an original transmitted signal, using the decoding time of the pulse signal. The signal mapping module 13C analyzes and maps the received character string and transmits instructions corresponding to the character string to the main processor 14. Overall operation of the signal analysis module 13 will be described in detail below.

This case is characterized in that the remote controller 20 and set top box 10 according to the exemplary embodiment of FIG. 3 use an entire code whose structure is different from that of a conventional pulse signal. Hereinafter, a structure of the entire code according to an exemplary embodiment of the present invention will be described.

Figure 4:
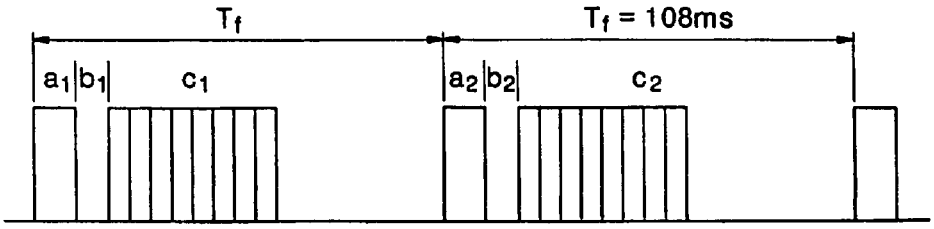
FIG. 4 shows an entire code structure used in a remote control system according to an exemplary embodiment of the present invention.

FIG. 4 is a view showing an entire code structure used in a remote control system according to an exemplary embodiment of the present invention.

Referring to FIG. 4, the entire code includes header pulses a1 and a2 and data pulses c1 and c2.

The entire code can have a period (Tf) of 108 ms like a general remote control signal. The header pulses a1 and a2 of the entire code have a high value during 9 ms. Further, the data pulses c1 and c2 that are transmitted after the header pulses include several pulses.

When a user pushes a button of the remote controller 20 once, the remote controller 20 according to an exemplary embodiment of the present invention repeatedly transmits the entire code including the header pulses and data pulses a predetermined number of times (twice in the case of FIG. 4).

Hereinafter, operation of the remote control system according to an exemplary embodiment of the present invention will be described with reference to the entire code whose structure is described above.

As shown in FIG. 4, when the user pushes the remote controller button 20 once, the remote controller 20 repeatedly transmits the entire code including the header pulses and data pulses several times. The set top box 10 extracts and decodes the data pulses from each repetition of the entire code. When there is no data transmission error, the set top box 10 receives an entire code for one instruction several times. In this case, since the set top box 10 would perform that instruction several times, the entire code processing module 13A of the signal analysis module 13 analyzes the signal as follows.

The entire code processing module 13A checks and stores numeric data received from the signal decoding module 12 and current time. The entire code processing module 13A determines whether or not to process the current received entire code using the difference between a time when a current entire code is decoded and a time when an entire code received immediately before is decoded. For example, it is assumed that the set top box 10 sequentially receives first and second entire codes. When the difference between the time when the first entire code is decoded and the time when the second entire code is decoded is higher than a pulse signal period of 108 ms, the entire code processing module 13A determines that first and second signals carrying different instructions are generated by pushing different buttons of the remote controller 20. Meanwhile, in the case that the decoding time difference between the first and second signals corresponds to the period of the pulse signal of 108 ms, the entire code processing module 13A recognizes that the second signal is a retransmitted version of the first signal even if the first signal is not recognized. Here, the set top box 10 can use a time difference of 110 ms rather than 108 ms in analyzing received signals in order to maintain high remote control reception efficiency.

With such a signal analysis method, even when the set top box 10 does not recognize the first signal emitted from the remote controller 20 due to noise, the user's instructions can be executed using a subsequent signal and thus malfunctions can also be prevented.

Figure 5:
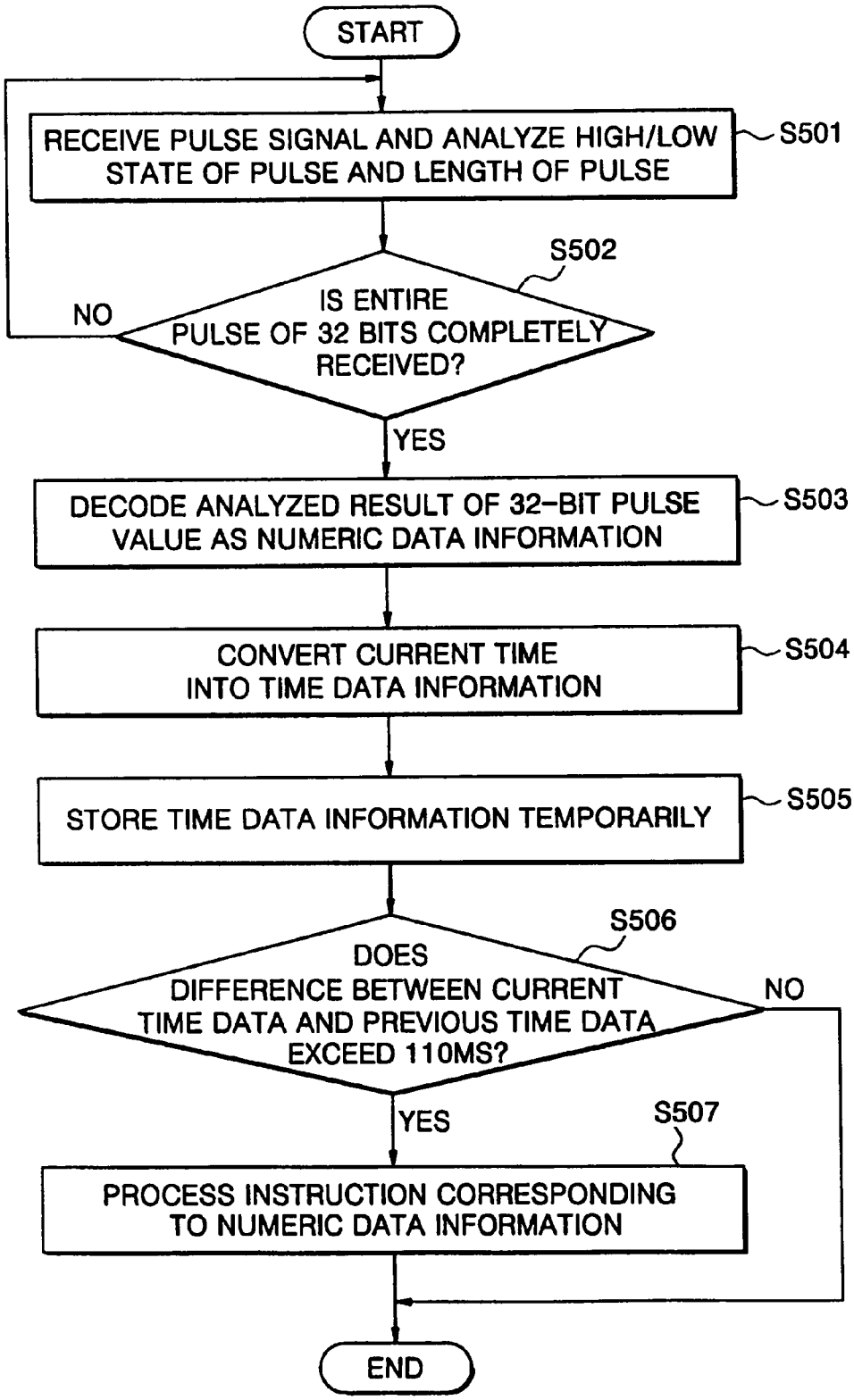
FIG. 5 is a flowchart illustrating a remote control signal decoding method of a set top box according to an exemplary embodiment of the present invention.

FIG. 5 is a flowchart illustrating a remote control signal decoding method of a set top box according to an exemplary embodiment of the present invention.

First, High/Low states and pulse lengths are analyzed for received pulses and their information is temporarily stored (S501). The set top box checks whether all 32 bits of a pulse signal are received (S502). When the set top box does not receive all of the pulse signal, it continues to receive the pulse signal until all 32 bits are received.

When the set top box receives a complete pulse signal, it decodes the pulse signal into numeric data using High/Low values of the pulse analyzed in step S501 (S503). Further, the set top box converts the decoding time into time data information (S504). Then, the set top box stores both the numeric data of step S503 and the time data of step S504 (S505).

The set top box determines whether or not the difference between a time when a current pulse signal is received and a time when a previous pulse signal was received exceeds 100 ms (S506). When the time difference exceeds 110 ms, the set top box recognizes the current received pulse signal as corresponding to a new instruction and processes the instruction corresponding to the numeric data information of step S503 (S507).

When the difference does not exceed 110 ms in step S506, the current received pulse signal corresponds to a retransmitted signal and thus the numeric data is disregarded and operation is ended.

Figure 6:
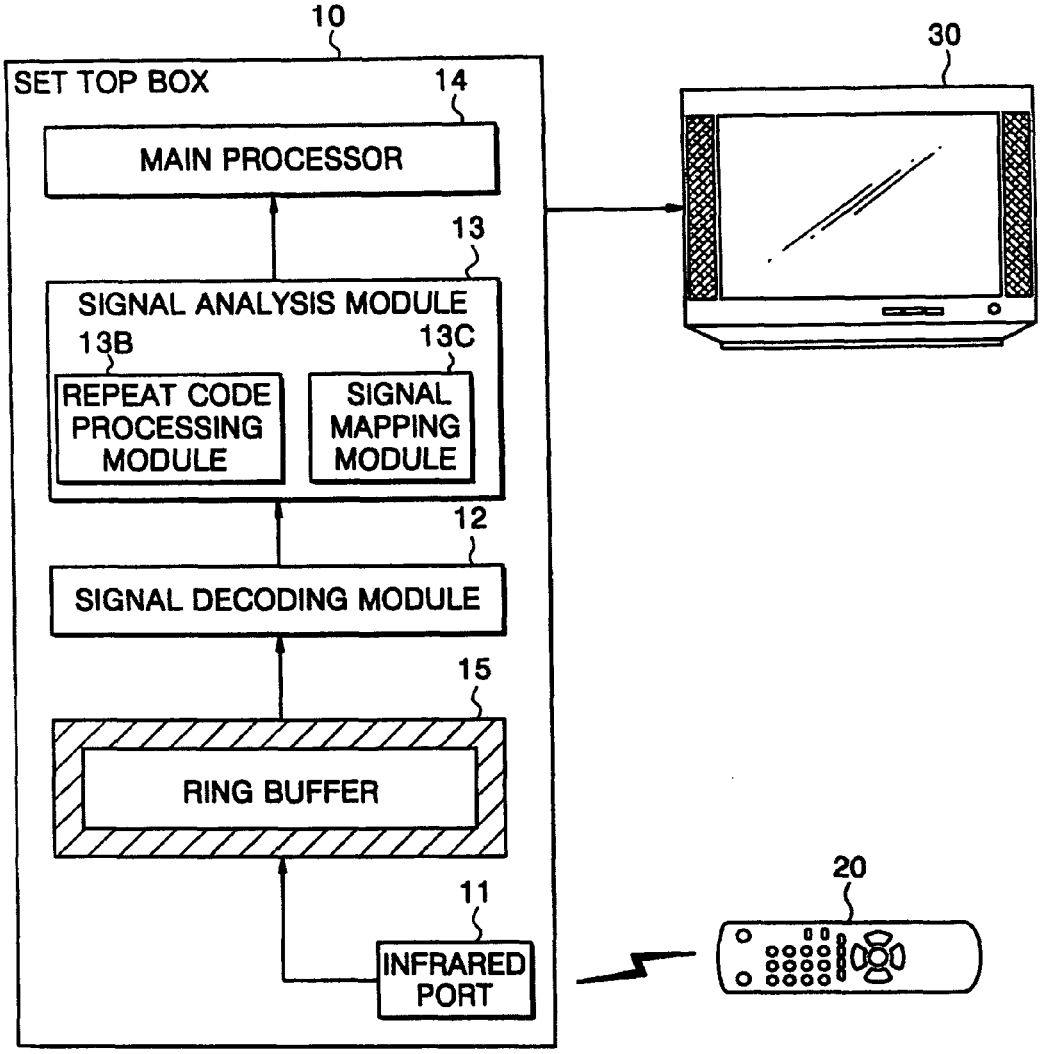
FIG. 6 is a block diagram showing the internal configuration of a remote control system according to another exemplary embodiment of the present invention.

FIG. 6 is a block diagram showing the internal configuration of a remote control system according to another exemplary embodiment of the present invention.

An infrared port 11, a main processor 14, and a ring buffer 15 shown in FIG. 6 are the same as in the exemplary embodiment of FIG. 3. The remote control system according to FIG. 6 is characterized in that it uses a start code, a repeat code and a repeat code processing module 13B. A structure of the repeat code will be described below.

Figure 7:
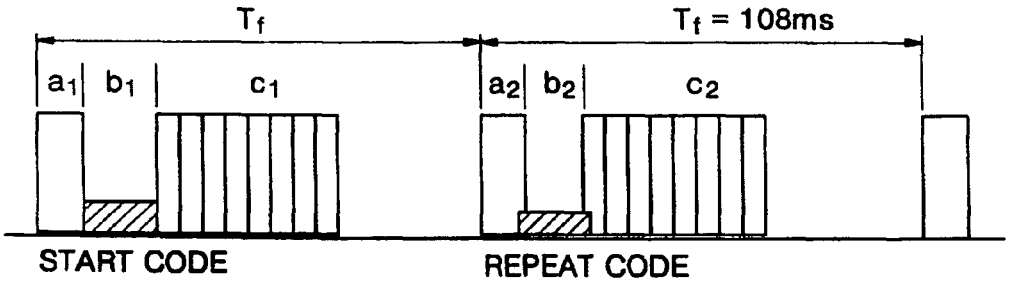
FIG. 7 is a view showing a configuration of repeat codes used by a remote control system according to an exemplary embodiment of the present invention.

FIG. 7 shows a configuration of the start code and repeat code used by a remote control system according to an exemplary embodiment of the present invention.

The start code and the repeat code transmitted by the remote controller can each have a period of 108 ms like the entire code of FIG. 4. One cycle of a remote control signal received by infrared port 11 includes a start code having a header pulse a1, a repeater pulse b1, and data pulses c1 followed by a repeat code having a header pulse a2, repeater pulse b2, and data pulses c2.

As shown in FIG. 7, the header pulses are pulses having a high value for a duration of 9 ms. The repeater pulses b1 and b2 are transmitted after the header pulses a1 and a2. In the case of a start code, a code that is not retransmitted but is transmitted for the first time, the repeater pulse b1 has a low value for 4.5 ms. On the other hand, in the case of a repeat code that is retransmitted with the provision that there was an error, the repeater pulse b2 has a low value for 2.25 ms. Thus, it is determined whether the repeat code received is a retransmitted signal or a signal transmitted for the first time according to length difference between the repeater pulses b1 and b2. Of course, the data pulses c1 and c2 are transmitted after the repeater pulses b1 and b2 in either case. Hereinafter, operation of the remote control system according to FIG. 6 will be described in detail on the basis of a structure of the repeat code.

The decoding module 12 decodes the start code and the repeat code and transmits numeric data information corresponding to the decoded start and repeat codes to the signal analysis module 13. Additionally, the signal decoding module 12 checks the length of the repeater pulses b1 and b2 following the header pulses and transmits it to the signal analysis module 13.

The signal analysis module 13 can include a repeat code processing module 13B and a signal mapping module 13C. The repeat code processing module 13B determines whether or not to process an instruction corresponding to the received repeat code using the length of the repeater pulses and the numeric data of the repeat code. First, the repeat code processing module 13B can recognize that the current received signal is a retransmitted signal with the provision that there was an error, when the repeater pulses have a length of 2.25 ms.

The repeat code processing module 13B compares numeric data generated by decoding a current received signal with numeric data generated by decoding a preceding received signal. When the numeric data generated by decoding the current received repeat code is the same as the numeric data generated by decoding the preceding received start code, there is no error signal so that the repeat code processing module 13B disregards the numeric data information corresponding to the current received repeat code.

When the numeric data generated by decoding the current received repeat code is different from the numeric data generated by decoding the preceding received start code, this indicates that a signal was discarded due to error during transmission. Therefore, the repeat code processing module 13B enables the signal mapping module 13C to transmit instructions corresponding to the current received repeat code to the main processor 14 and to process the instructions. Using such a method, the set top box 10 can recover from signal reception failures due to noise, etc. using the retransmitted repeat code.

Figure 8:
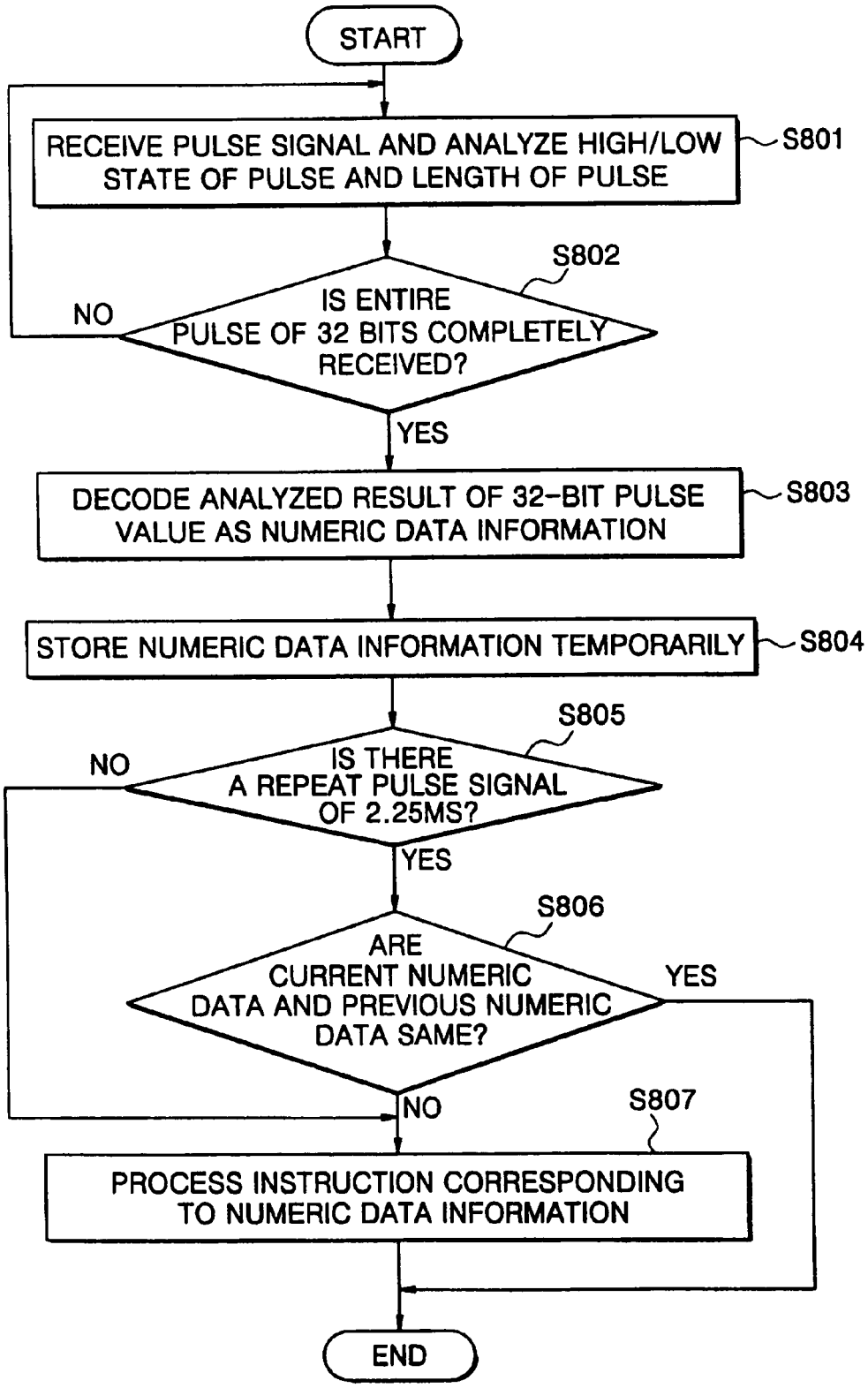
FIG. 8 is a flowchart illustrating a remote control signal decoding method of a set top box according to another exemplary embodiment of the present invention.

FIG. 8 is a flowchart illustrating a remote control signal decoding method of a set top box according to another exemplary embodiment of the present invention.

High/Low states and lengths of received pulses are analyzed (S801). A header pulse signal and a data pulse signal are extracted through such a process. As in the embodiment shown in FIG. 5, pulse signal reception continues until the entire 32-bit pulse signal is completely received (S802), and then the pulses are decoded and converted into numeric data (S803).

The set top box temporarily stores the numeric data extracted in step S803 (S804). Then, it is determined whether the received remote control signals are retransmitted signals using analysis results of step S801 (S805). The set top box makes this determination using the length of the repeater pulses included in the remote control signal. When the length of the repeater pulses is 2.25 ms, it is determined whether the preceding stored numeric data and the numeric data of step S803 are the same by comparing them (S806). When the length of the repeater pulses in the pulse signal received in step S805 is not 2.25 ms, or the numeric data are determined to be different with each other in step S806, an instruction corresponding to the numeric data of the current received pulse signal is processed (S807). Otherwise, when the numeric data are determined to be the same in step S806, operation is ended.

Figure 9:
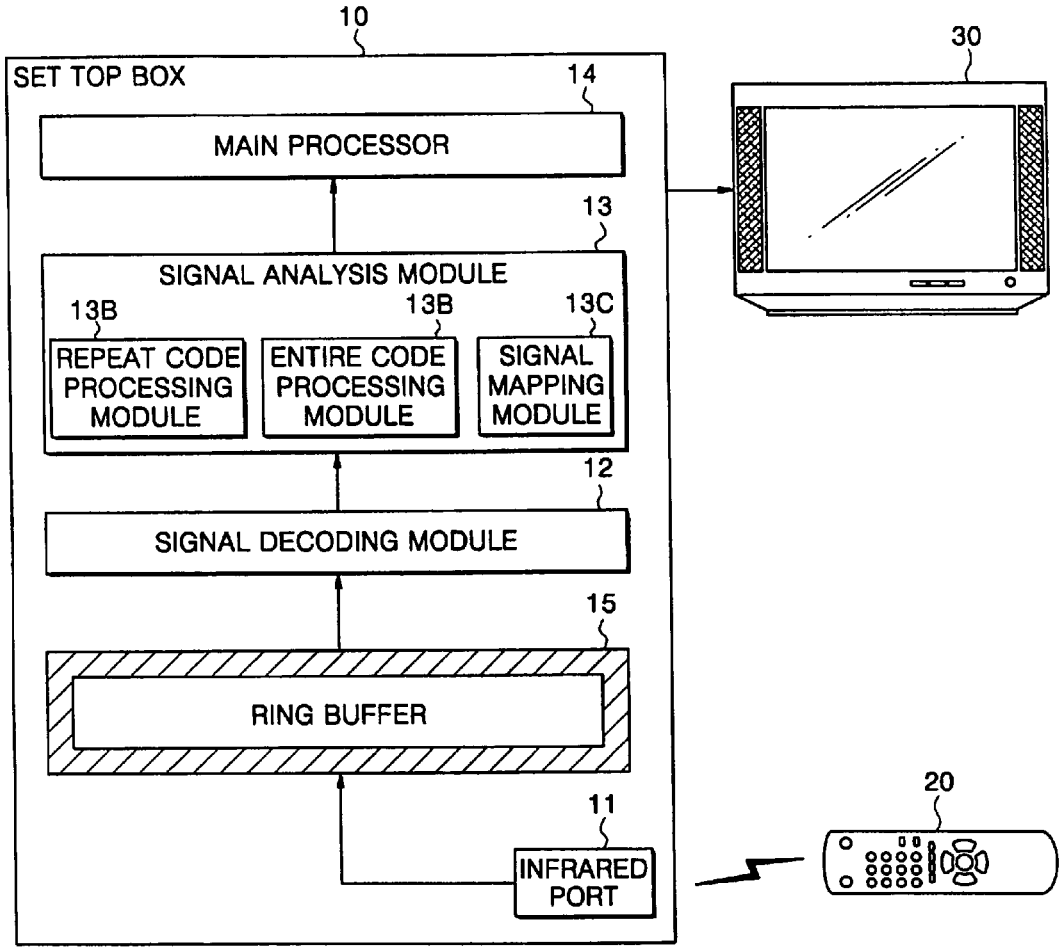
FIG. 9 is a block diagram showing the internal configuration of a remote control system according to yet another exemplary embodiment of the present invention.

FIG. 9 is a block diagram showing the internal configuration of a remote control system according to yet another exemplary embodiment of the present invention.

A set top box 10 shown in FIG. 9 is characterized in that it includes all functions described in FIGS. 3 and 6. That is, the set top box 10 is characterized in that it can process all remote control signals transmitted by the remote controller 20 regardless of the configuration of the entire codes shown in FIG. 4 or the configuration of the codes shown in FIG. 7. Additionally, the set top box 10 shown in FIG. 9 can process conventional remote control signals.

Components such as the infrared port 11, the main processor 14 and the ring buffer 15 have the same functions as described above. The signal decoding module 12 decodes a received pulse signal and transmits numeric data corresponding to the decoded signal to the signal analysis module 13. In this case, the signal decoding module 12 checks a length of the repeater pulses in the signals received by the infrared port 11, and transmits its result to the signal analysis module 13. The signal analysis module 13 includes an entire code processing module 13A, a repeat code processing module 13B, and a signal mapping module 13C. Of course, a function of each module is the same as described in FIGS. 3 and 6. Hereinafter, a decoding method using a set top box including such a module will be described.

Figure 10:
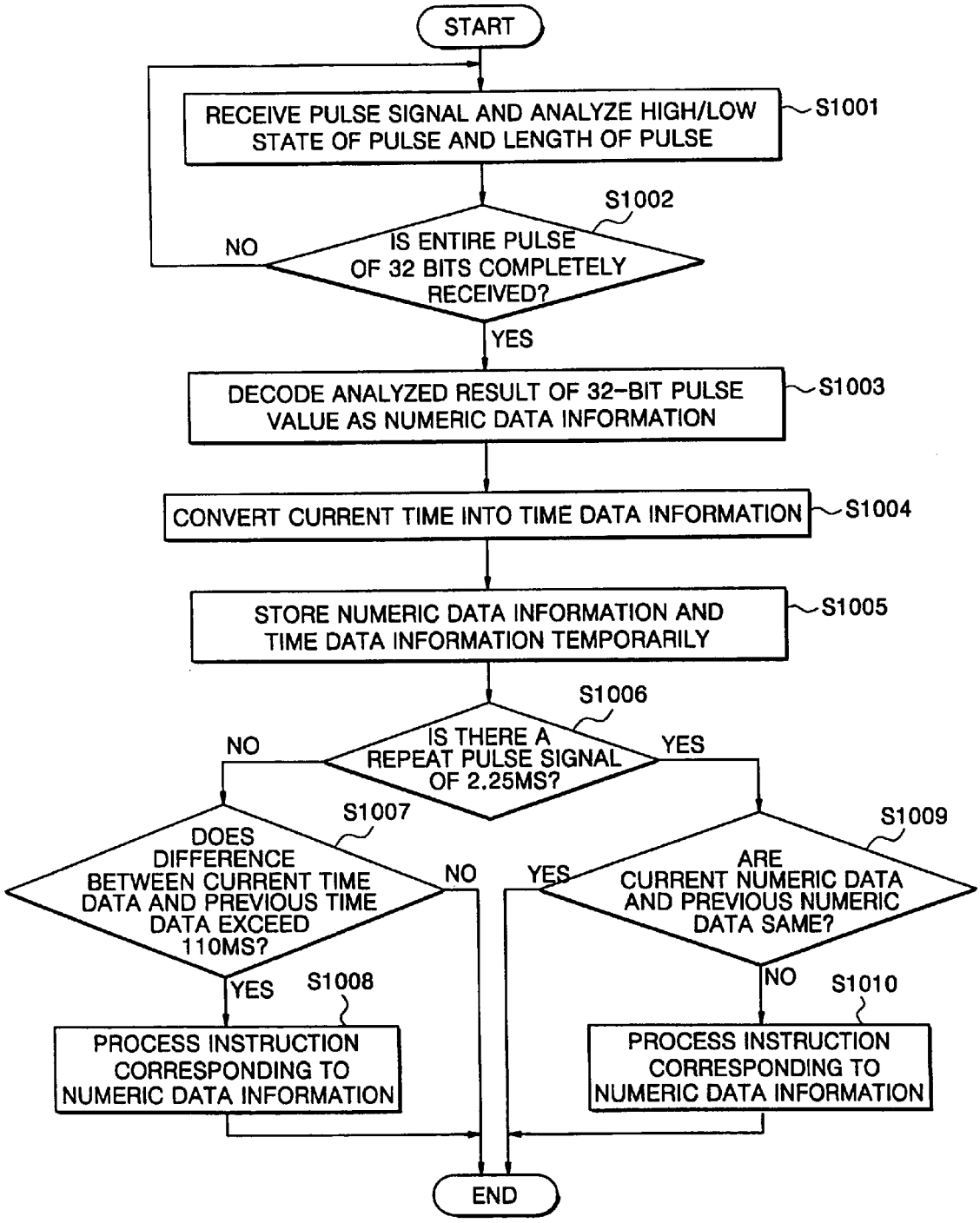
FIG. 10 is a flowchart illustrating a remote control signal decoding method of a set top box according to yet another exemplary embodiment of the present invention.

FIG. 10 is a flowchart illustrating a remote control signal decoding method of a set top box according to yet another exemplary embodiment of the present invention.

The decoding method according to FIG. 10 is characterized in that it can process all conventional remote control signals and remote control signals including the entire code or the start and repeat codes according to the present invention.

First, the set top box analyzes High/Low states and length of the pulses for received remote control signals (S1001). Using such a process, the set top box can extract header pulses, repeater pulses and data pulses. In the same manner as FIG. 5, the set top box receives the pulses until the entire 32 bits of pulses of are completely received (S1002) and decodes the pulses and converts them into numeric data (S1003).

The set top box converts current time generated by decoding the remote control signal into time data information (S1004), and temporarily stores numeric data information and time data information (S1005). Then, the set top box determines whether there are repeater pulses of 2.25 ms in the received remote control signal using an analysis result of step S1001 (S1006). It is performed to determine whether the repeat codes correspond to a remote control signal applied.

When it is determined that the remote control signals have the repeater pulses having the length of 2.25 ms in step S1006, a method for decoding the repeat code is applied. That is, the remote control signal having a structure of a repeat codes is decoded as follows. It is first determined whether the numeric data information generated by decoding current received remote control signals is the same as numeric data information generated by decoding remote control signals received immediately before the current remote control signals (S1009). When both numeric data information are different from each other, an instruction corresponding to the numeric data of the current received remote control signals is processed (S1010). Meanwhile, when both numeric data information are the same, the operation is ended.

Meanwhile, in the case that the remote control signals received in step S1006 do not have the repeater pulses of 2.25 ms (as in the case of having the repeater pulses of 4.5 ms), the following steps will be followed. That is, the remote control signals having the entire code structure or the conventional remote control signals will be decoded in a method to be described below. First, time data generated by decoding current received remote control signals is compared with that generated by decoding remote control signals received immediately before (S1007). Even in the case of using either of the two types of remote control signals, if the difference between decoding time of current received remote control signals and that of the remote control signals received immediately before exceeds 110 ms, the current received remote control signals are determined to correspond to a separate user command or there was an error in the remote control signals received immediately before the current received remote control signals. Therefore, the set top box processes instructions corresponding to numeric data information in step S1003 (S1008). However, in the case of using the conventional remote control signals, when there is an error in the remote control signals received immediately before the currently received remote control signals, current remote control signals including only remote control pulses will not be processed. In the case that the reception time difference does not exceed ms in step S1007, operation is ended.

Figure 11:
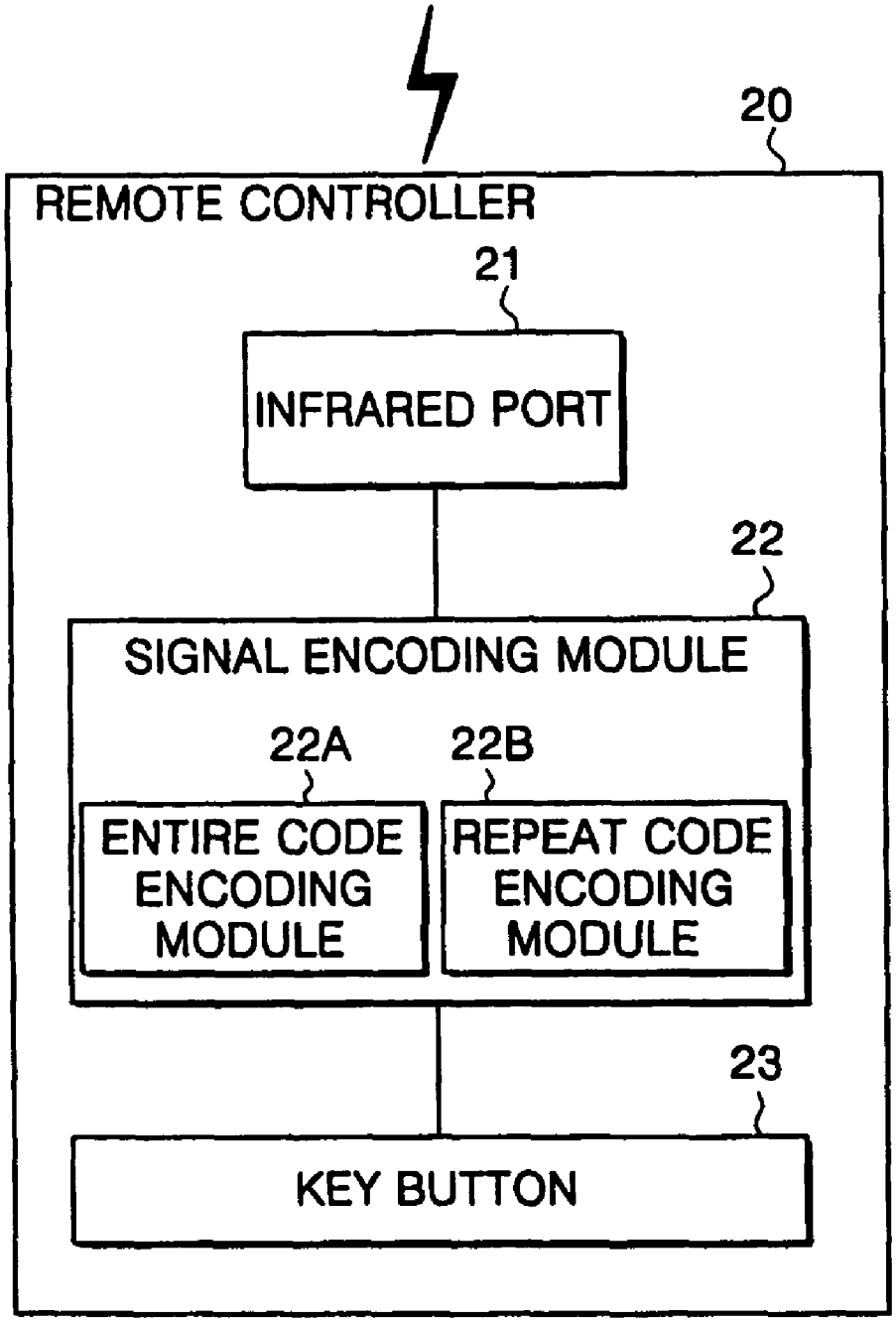
FIG. 11 is a block diagram showing the internal configuration of a remote controller according to yet another exemplary embodiment of the present invention.

FIG. 11 is a block diagram showing the internal configuration of a remote controller according to yet another exemplary embodiment of the present invention.

As shown in FIG. 11, the remote controller 20 can include an infrared port 21, a signal encoding module 22, and a key button 23. The key button 23 is an input unit to operate electrical equipment such as a set top box. When a user pushes a button of the key button 23, the signal encoding module 22 encodes a signal corresponding to the button and generates pulses. The signal encoding module 22 can include the entire code encoding module 22A and a repeat code encoding module 22B. The entire code encoding module 22A generates an entire code in which header pulses and data pulses according to a user's operation are repeated a predetermined number of times. On the contrary, a repeat code encoding module 22C generates a repeat code in which the header pulses, data pulses, according to a user's instruction, and a repeater pulse having a different pulse length according to whether a signals is retransmitted to prevent an error is repeated a predetermined number of times. Of course, the signal encoding module 22 may generate a remote control signal having an existing pulse structure according to a user's selection. Various kinds of pulse signals generated in the signal encoding module 22 are transmitted to the infrared port 21. The infrared port 21 emits infrared signals and transmits them to the set top box.

For example, the exemplary embodiments of the present invention are applied to a remote control system configured of a remote controller and a set top box. However, it is obvious that the present invention may also be applied to various kinds of electronic equipment such as a TV, a cable broadcast converter, a satellite broadcast converter, an audio system, an air conditioner, etc., in addition to the set top box. Further, the present invention has been described with reference to the case where the period of the remote control signal is 108 ms as an exemplary embodiment. However, it is obvious that the present invention can also be applied to a remote controller which uses different periods or frequencies since characteristics of the present invention are not related to the period/frequency of the remote control signal.

According to the remote control system and method having reduced vulnerability to noise according to the present invention, in the case of there being so many possibilities of malfunctions due to the fact that there are optical signals similar to the infrared signals used in the remote controller, malfunctions can be controlled by transmitting entire code including the header pulses and the data pulses in the remote controller or transmitting repeat code including the repeater pulses and data pulses, and receiving the entire code or the repeat code and recovering errors using the entire code and repeat code in the set top box.

While the present invention has been described with reference to exemplary embodiments thereof, it will be understood by those skilled in the art that various changes in form and details may be made therein without departing from the spirit and scope of the present invention as defined by the following claims.

What is claimed is:

1. A remote control system, comprising:

a remote controller to transmit a first remote control signal comprising header pulses and data pulses at a first time, and a second remote control signal comprising header pulses, data pulses, and repeater pulses at a second time, the repeater pulses having a first pulse length or a second pulse length depending on whether the transmission of the second remote control signal is an original transmission or a retransmission; and a remote control receiver to receive and decode the first remote control signal or the second remote control signal, and to selectively process instructions corresponding to the first remote control signal or the second remote control signal.

2. The remote control system according to claim 1, wherein the remote control receiver comprises:

a signal decoding module to extract numeric data by decoding the first remote control signal or the second remote control signal, and to check a length of the repeater pulses and a time when the first remote control signal or the second remote control signal is decoded;

a signal analysis module to determine whether to process instructions corresponding to the numeric data using the decoding time and the length of the repeater pulses; and a main processor to process the instructions corresponding to the numeric data.

3. The remote control system according to claim 2, wherein the signal analysis module comprises:

a signal mapping module to transmit instructions mapped to the numeric data to the main processor;

an entire signal processing module to activate the signal mapping module if a difference between the time when the first remote control signal is decoded and a time when an immediately preceding remote control signal is decoded is longer than a period of the first remote control signal; and a repeat code processing module to activate the signal mapping module if the repeater pulses have a second pulse length and if the numeric data generated by decoding the second remote control signal is different from numeric data generated by decoding an immediately preceding remote control signal.

4. The remote control system according to claim 3, wherein the first pulse length is 4.5 ms and the second pulse length is 2.25 ms.

5. A remote control receiver, comprising:

an infrared port to receive a remote control signal comprising either header pulses and data pulses or header pulses, data pulses, and repeater pulses, the repeater pulses having a first pulse length or a second pulse length depending on whether transmission of the remote control signal is an original transmission or a retransmission;

a signal decoding module to extract numeric data by decoding the received remote control signal, and to check a length of the repeater pulses and a time when the remote control signal is decoded;

a signal analysis module to determine whether to process instructions corresponding to the numeric data using the decoding time and the length of the repeater pulses; and a main processor to process the instructions corresponding to the numeric data.

6. The remote control receiver according to claim 5, wherein the signal analysis module comprises:

a signal mapping module to transmit instructions mapped to the numeric data to the main processor;

an entire signal processing module to activate the signal mapping module if the repeater pulses have a first pulse length and if a difference between the time when the remote control signal is decoded and a time when an immediately preceding remote control signal is decoded is longer than a period of the remote control signal; and a repeat code processing module to activate the signal mapping module if the repeater pulses have a second pulse length and if the numeric data generated by decoding the remote control signal is different from numeric data generated by decoding an immediately preceding remote control signal.

7. A remote controller comprising a signal encoding module to transmit a first remote control signal comprising header pulses and data pulses at a first time, and a second remote control signal comprising header pulses, data pulses, and repeater pulses at a second time, the repeater pulses having a first pulse length or a second pulse length depending on whether the transmission of the second remote control signal is an original transmission or a retransmission, wherein the first time is different than the second time.

8. A remote control system, comprising:

a remote controller to repeatedly transmit a code comprising header pulses, data pulses, and repeater pulses, the repeater pulses having a first pulse length or a second pulse length depending on whether the transmission of the code is an original transmission or a retransmission; and a remote control receiver to receive and decode the code, and to selectively process instructions corresponding to the decoded code using a pulse length of the repeater pulses.

9. The remote control system according to claim 8, wherein the remote control receiver comprises:

a signal decoding module to extract numeric data by decoding the received code, and to check the pulse length of the repeater pulses;

a signal analysis module to determine whether to process instructions corresponding to the numeric data using the pulse length of the repeater pulses; and a main processor to process the instructions corresponding to the numeric data.

10. The remote control system according to claim 9, wherein the signal analysis module comprises:

a signal mapping module to transmit instructions mapped to the numeric data to the main processor; and a repeat code processing module to activate the signal mapping module if the repeater pulses have a first pulse length, or if the repeater pulses have a second pulse length and the numeric data generated by decoding the code is different from numeric data generated by decoding an immediately preceding code.

11. The remote control system according to claim 10, wherein the first pulse length is 4.5 ms and the second pulse length is 2.25 ms.

12. A remote control receiver, comprising:

an infrared port to receive a code comprising header pulses, data pulses, and repeater pulses, the repeater pulses having a first pulse length or a second pulse length according to whether transmission of the code is an original transmission or a retransmission;

a signal decoding module to extract numeric data by decoding the code and to check a length of the repeater pulses;

a signal analysis module to determine whether to process instructions corresponding to the numeric data using the length of the repeater pulses; and a main processor to process the instructions corresponding to the numeric data.

13. A remote controller to repeatedly transmit codes comprising header pulses, data pulses, and repeater pulses, the repeater pulses having different pulse lengths depending on whether the transmission of the code is an original transmission or a retransmission.

14. The remote controller according to claim 13, wherein the remote controller comprises a signal encoding module to transmit repeater pulses having a pulse length of 4.5 ms in the original transmission and repeater pulses having a pulse length of 2.25 ms in the retransmission.

15. A method to operate a remote control system, comprising:

transmitting a first remote control signal comprising header pulses and data pulses at a first time and a second remote control signal comprising header pulses, data pulses, and repeater pulses at a second time, the repeater pulses having a first pulse length or a second pulse length depending on whether the transmission of the second remote control signal is an original transmission or a retransmission; and receiving and decoding the first remote control signal or the second remote control signal; and selectively processing instructions corresponding to the decoded first remote control signal or the decoded second remote control signal using the repeater pulses and a decoding time when the first remote control signal or the second remote control signal is decoded.

16. The method according claim 15, wherein selectively processing the instructions corresponding to the first remote control signal or the second remote control signal comprises:

extracting numeric data from the decoded first remote control signal or the decoded second remote control signal and checking the decoding time and a length of the repeater pulses;

processing the instructions corresponding to the numeric data if a difference between the time when the first remote control signal is decoded and a time when an immediately preceding remote control signal is decoded is longer than a period of the first remote control signal; and processing the instructions corresponding to the numeric data if the repeater pulses have a second pulse length and if the numeric data generated by decoding the second remote control signal is different from numeric data generated by decoding an immediately preceding remote control signal.

17. The method according to claim 16, wherein the first pulse length is 4.5 ms and the second pulse length is 2.25 ms.

18. A method to operate a remote control system, comprising:

repeatedly transmitting, at a remote controller, codes comprising header pulses, data pulses, and repeater pulses, the repeater pulses having a first pulse length or a second pulse length according to whether the transmission of the codes is an original transmission or a retransmission; and receiving and decoding the codes; and selectively processing instructions corresponding to the codes using a length of the repeater pulses.

19. The method according to claim 18, wherein selectively processing the instructions corresponding to the codes comprises:

extracting numeric data from the decoded codes, and checking the length of the repeater pulses; and processing the instructions corresponding to the numeric data if the repeater pulses have a first pulse length or if the repeater pulses have a second pulse length and the numeric data generated by decoding the code is different from numeric data generated by decoding an immediately preceding code.

20. The method according to claim 19, wherein the first pulse length is 4.5 ms and the second pulse length is 2.25 ms.

* * * * *